US010208573B2

(12) United States Patent
Von Kaenel et al.

(10) Patent No.: US 10,208,573 B2
(45) Date of Patent: Feb. 19, 2019

(54) PERFORATING GUN WITH INTEGRATED RETAINING SYSTEM

(71) Applicant: HALLIBURTON ENERGY SERVICES, INC., Houston, TX (US)

(72) Inventors: Scott Von Kaenel, Fort Worth, TX (US); Richard Ellis Robey, Mansfield, TX (US); Marcelo Jorge Laxalt, The Colony, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 4 days.

(21) Appl. No.: 15/503,675

(22) PCT Filed: Sep. 10, 2014

(86) PCT No.: PCT/US2014/054879
§ 371 (c)(1),
(2) Date: Feb. 13, 2017

(87) PCT Pub. No.: WO2016/039734
PCT Pub. Date: Mar. 17, 2016

(65) Prior Publication Data

US 2017/0275974 A1 Sep. 28, 2017

(51) Int. Cl.
*E21B 43/16* (2006.01)
*E21B 43/116* (2006.01)
(Continued)

(52) U.S. Cl.
CPC ..... *E21B 43/116* (2013.01); *E21B 43/16* (2013.01); *E21B 43/117* (2013.01); *E21B 43/119* (2013.01)

(58) Field of Classification Search
CPC .... E21B 17/046; E21B 43/119; E21B 43/116; E21B 43/117
See application file for complete search history.

(56) References Cited

U.S. PATENT DOCUMENTS 3,045,748 A * 7/1962 Schramm ..... E21B 23/02 166/214
3,471,177 A 10/1969 Garrett et al.
(Continued)

FOREIGN PATENT DOCUMENTS

CA 2821506 A1 * 1/2015 ..... E21B 43/117
WO 2008144243 A1 11/2008

OTHER PUBLICATIONS

International Search Report and Written Opinion; PCT Application No. PCT/US2014/054879; dated Jun. 1, 2015.
(Continued)

*Primary Examiner* — Jennifer H Gay
(74) *Attorney, Agent, or Firm* — Polsinelli PC

(57) ABSTRACT

An apparatus comprising a charge tube for a perforating gun assembly used in harvesting energy in a wellbore and a retaining projection formed on an end of the charge tube. When the charge tube is inserted into a gun body, the retaining projection engages with the gun body of the perforating gun assembly to restrict movement of the charge tube with respect to the gun body when engaged with the gun body. The retaining projection can comprise a plurality of collet fingers on an end of the charge tube that engage with the gun body to longitudinally retain the charge tube. The retaining projection can comprise at least one alignment finger that limits radial movement of the charge tube with respect to the gun body. The retaining projection can comprise a plurality of centralizing bend tabs that restrict radial movement of the charge tube when inserted into the gun body.

17 Claims, 5 Drawing Sheets

(51) Int. Cl.
*E21B 43/117* (2006.01)
*E21B 43/119* (2006.01)

(56) References Cited

U.S. PATENT DOCUMENTS

| | | | | |
|---|---|---|---|---|
| 6,158,511 | A * | 12/2000 | Wesson | E21B 37/08 166/297 |
| 8,336,437 | B2 | 12/2012 | Barlow et al. | |
| 2003/0047358 | A1* | 3/2003 | Bonkowski | E21B 43/116 175/4.6 |
| 2004/0216866 | A1* | 11/2004 | Barlow | E21B 17/042 166/55 |
| 2005/0016728 | A1* | 1/2005 | Sloan | E21B 17/046 166/298 |
| 2007/0084336 | A1* | 4/2007 | Neves | E21B 43/119 89/1.3 |
| 2014/0076631 | A1 | 3/2014 | Rodgers et al. | |
| 2016/0084048 | A1* | 3/2016 | Harrigan | E21B 43/119 175/4.57 |
| 2016/0290084 | A1* | 10/2016 | LaGrange | E21B 29/02 |
| 2017/0052011 | A1* | 2/2017 | Parks | F42D 1/02 |
| 2017/0268317 | A1* | 9/2017 | Von Kaenel | E21B 43/116 |
| 2017/0275974 | A1* | 9/2017 | Von Kaenel | E21B 43/116 |

OTHER PUBLICATIONS

International Preliminary Report on Patentability;PCT Application No. PCT/US2014/054879; dated Sep. 23, 2015.

* cited by examiner

PERFORATING GUN WITH INTEGRATED RETAINING SYSTEM

CROSS-REFERENCE TO RELATED APPLICATIONS

This application is a national stage entry of PCT/US2014/054879 filed Sep. 10, 2014, said application is expressly incorporated herein in its entirety.

FIELD

The present technology pertains to perforation tool assemblies, and more specifically pertains to retaining systems for perforating guns and perforating tool assemblies.

BACKGROUND

Wellbores are drilled into the earth for a variety of purposes including tapping into hydrocarbon bearing formations to extract the hydrocarbons for use as fuel, lubricants, chemical production, and other purposes. When a wellbore has been completed, a metal tubular casing may be placed and cemented in the wellbore. Thereafter, a perforation tool assembly may be run into the casing, and one or more perforation guns in the perforation tool assembly may be activated and/or fired to perforate the casing and/or the formation to promote production of hydrocarbons from selected formations. Perforation guns may comprise one or more explosive charges that may be selectively activated, the detonation of the explosive charges desirably piercing the casing and penetrating at least partly into the formation proximate to the wellbore.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed systems may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics described in more detail below, will be readily apparent to those skilled in the art with the aid of this disclosure upon reading the following detailed description, and by referring to the accompanying drawings.

DESCRIPTION

Figure 1:
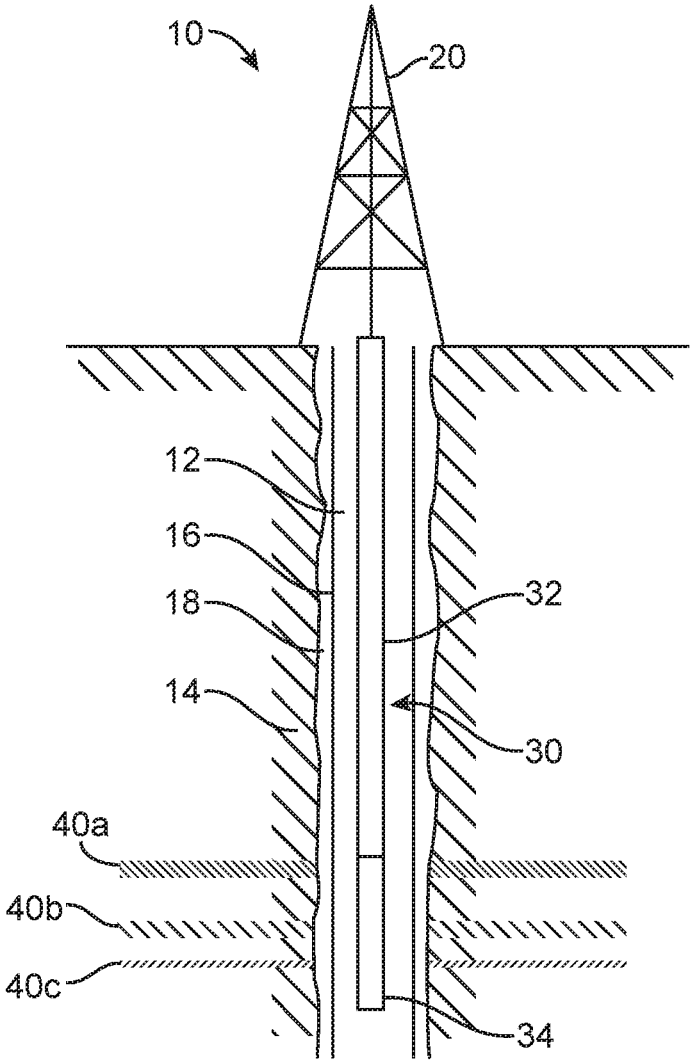
FIG. 1 is a schematic diagram of a wellbore and workstring according to an embodiment of the disclosure.

Turning now to FIG. 1, a wellbore servicing system 10 is described. The system 10 comprises servicing rig 20 that extends over and around a wellbore 12 that penetrates a subterranean formation 14 for the purpose of recovering hydrocarbons from a first production zone 40*a*, a second production zone 40*b*, and/or a third production zone 40*c*, collectively the production zones "40". The wellbore 12 may be drilled into the subterranean formation 14 using any suitable drilling technique. While shown as extending vertically from the surface in FIG. 1, the wellbore 12 may also be deviated, horizontal, and/or curved over at least some portions of the wellbore 12. For example, the wellbore 12, or a lateral wellbore drilled off of the wellbore 12, may deviate and remain within one of the production zones 40. The wellbore 12 may be cased, open hole, contain tubing, and may generally comprise a hole in the ground having a variety of shapes and/or geometries as is known to those of skill in the art. In the illustrated embodiment, a casing 16 may be placed in the wellbore 12 and secured at least in part by cement 18.

The servicing rig 20 may be one of a drilling rig, a completion rig, a workover rig, or other mast structure and supports a workstring 30 in the wellbore 12, but a different structure may also support the workstring 30. The servicing rig 20 may also comprise a derrick with a rig floor through which the workstring 30 extends downward from the servicing rig 20 into the wellbore 12. In some embodiments, such as in an off-shore location, the servicing rig 20 may be supported by piers extending downwards to a seabed. Alternatively, in some embodiments, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, another servicing vehicle, a coiled tubing unit and/or other apparatus.

In an embodiment, the workstring 30 may comprise a conveyance 32 and a perforation tool assembly 34. The conveyance 32 may be any of a string of jointed pipes, a slickline, a coiled tubing, and a wireline. In other embodiments, the workstring 30 may further comprise one or more downhole tools (not shown in FIG. 1), for example above the perforation tool assembly 34. The workstring 30 may comprise one or more packers, one or more completion components such as screens and/or production valves, sensing and/or measuring equipment, and other equipment which are not shown in FIG. 1. In some contexts, the workstring 30 may be referred to as a tool string. The workstring 30 may be lowered into the wellbore 12 to position the perforation tool assembly 34 to perforate the casing 16 and penetrate one or more of the production zones 40.

The system 10 is typically assembled on the field and individual charge tubes are inserted into gun bodies of the perforation gun assemblies by, for example, a gun loader. Each charge tube is assembled, for example by adding the charges, and then the charge tube is inserted into the gun body and aligned with the scallops of the gun body.

Figure 2:
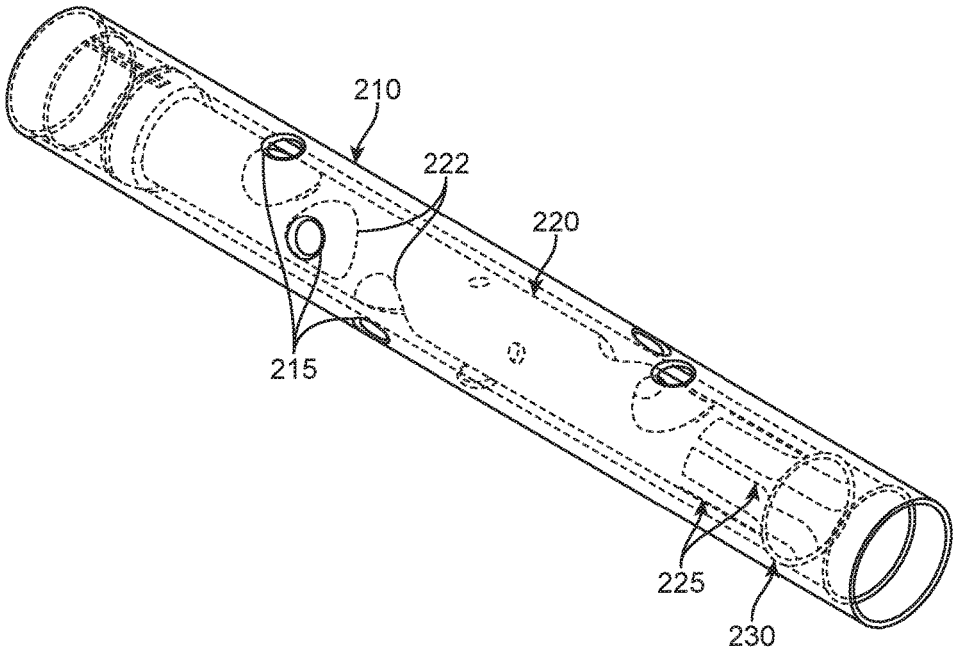
FIG. 2 is a diagram of a partially-assembled gun body with a charge tube having a plurality of collet fingers received in the gun body.

Reference is now made to FIG. 2 showing a diagram of a partially-assembled gun body with a charge tube retained therein, the charge tube having a plurality of protrusions on an end for retaining the charge tube within the gun body.

A gun body 210, as part of an overall perforation gun assembly, for example the assembly 34 shown in FIG. 1, has a plurality of recesses or "scallops" 215 on an exterior surface of the gun body 210. The scallops 215 provide a path for the charge material to more easily blast through after detonation of charges (not shown in FIG. 2). The gun body 210 is for receiving a charge tube 220. The charge tube 220 has a plurality of openings 225 on an exterior surface thereof for receiving a plurality of charges. A "charge" generally has a steel outer casing that contains an explosive powder or similar material that is activated and pierces through the scallops 215 of the gun body 210. The charge tube 220 has a plurality of collet fingers 225 formed on an end thereof that engage a groove 230 on an interior surface of the gun body 210 as the charge tube is inserted into the gun body. The collet fingers 225 retain the charge tube longitudinally within the gun body 210.

Figure 3:
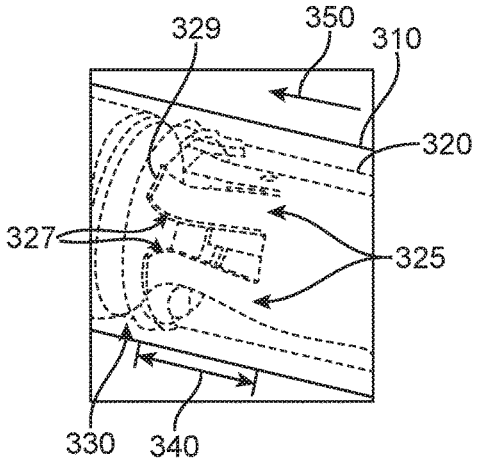
FIG. 3 is a diagram of a charge tube and integrated retaining system as received in a gun body, according to an embodiment of the disclosure.

Reference is now made to FIG. 3 which is a diagram of a charge tube and integrated retaining system as received in a gun body, according to an embodiment of the disclosure.

As shown in FIG. 3, a gun body 310 receives a charge tube 320 within an overall perforating gun assembly as part of a workstring supported on a structure, for example servicing rig 20 supporting a workstring 30 shown in FIG. 1. The charge tube 320 includes a plurality of projections 325, referred to as collet fingers 325. The collet fingers 325 are curved at 327 to form an end 329 of the collet fingers 325. The end 329 of the collet fingers 325 engages with a groove 330 on an interior surface of the gun body 310 as the charge tube 320 is inserted into the gun body 310. The direction of insertion of the charge tube 320 within the gun body 310 is shown by the direction of arrow 350.

The charge tube and gun body can be formed of any material, such as plastics, metals, ceramics, foams, and other materials within ordinary skill can be employed. The charge tube and gun body can also be formed of the same material or two different materials depending upon the particular application for which the charge tube and gun body is being used.

The collet fingers 325 retain the charge tube longitudinally within the gun body (in direction of arrow 350). By modifying the ends of the charge tube 320 to function as collet fingers 325, the charge tube 320 acts as its own retaining and positioning mechanism. The collet fingers 325 can be manufactured according to techniques known to those of ordinary skill in the art. This includes typical manufacturing methods, such as cutting, machining, molding, casting, or sintering. Other manufacturing methods for forming or otherwise defining the collet fingers will be apparent to those of ordinary skill.

For loading purposes, the collet fingers 325 can be compressed using a clamping device (not shown, but can be compressed at bend 327, for example, or at the ends 329) or by the pressure of the internal diameter of the gun body 310 (pressing on the ends 329 of the charge tube) to allow the charge tube 320 to be slid into and out of the gun body 310. Once the charge tube 320 is fully loaded within the gun body 310, it is positioned in the gun body with the collet fingers 325 sprung against the locating groove 330, as shown in FIG. 3. To help disable any movement, the locating groove 330 in the gun body 310 can be modified to allow the tabs to confront an edge on each side. If a load gun was not activated for any reason, it can be downloaded through removal of the charge tube and uninitiated charges from the gun assembly. A device can be used to suppress the collet fingers 325 on each end and the charge tube 320 can be removed. The suppressing device (not shown in FIG. 3) could also be integral to the gun body 310. The collet fingers replace the need for two snap rings that can be utilized to keep a charge tube (that does not have the collet fingers) horizontally retained within the gun body.

Figure 4:
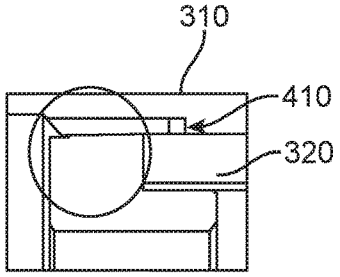
FIG. 4 is a diagram of a charge tube received in a gun body showing a milled slot on an interior surface of the gun body, as viewed in cross-section from the side, according to an embodiment of the disclosure.

FIG. 4 is a diagram of a charge tube received in a gun body showing the milled slot in the gun body as viewed in cross-section from the side, according to an embodiment of the disclosure.

At least one longitudinal milled slot 410 is formed in the gun body 310 that is used to properly align the charge tube 320 with the appropriate scallop(s) of the gun body. The gun body 310 includes the milled slot 410 which can be used in aligning the charge tube 320 within the gun body 310.

Figure 5:
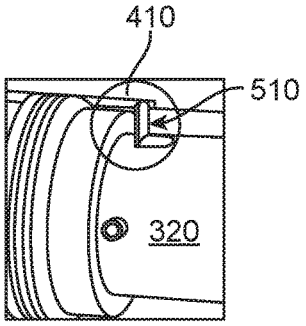
FIG. 5 is a diagram of an illustration of an alignment finger integrated on a surface of a charge tube for engaging the milled slot of the gun body, according to an embodiment of the disclosure.

FIG. 5 is a diagram of an illustration of an alignment finger integrated on a surface of a charge tube for engaging the milled slot, according to an embodiment of the disclosure.

A surface of the charge tube 320 is modified in FIG. 5 to have at least one alignment finger 510, which comprises a tab that is bent vertically to engage at least one milled slot 510 on an inner surface of the gun body 310. Although a single alignment finger and corresponding slot are illustrated, multiple alignment fingers and associated slots can be incorporated as appropriate. The alignment finger 510 replaces any need for a set screw in gun assemblies and a corresponding milled hole in an alignment fixture, by the alignment finger 510 engaging a milled slot 510 that is already present on an interior surface of the gun body. The alignment finger 510 retains the functionality of the charge and scallop alignment while removing secondary components and streamlining assembly of the charge tube within the gun body. In addition, the alignment finger eliminates the operation of inserting a set screw through the alignment fixture into the milled slot (510) that would have to be done by a gun loader. This provides a tool-less (i.e., not requiring a tool) structure for inserting and aligning a charge tube within a gun body.

Figure 6:
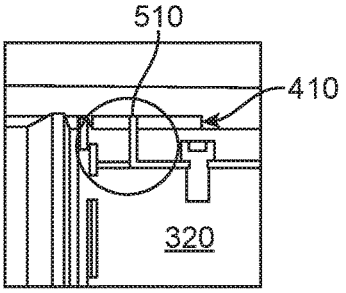
FIG. 6 is an illustration of a charge tube having an integrated alignment finger engaged with the milled slot on the interior surface of the gun body, as viewed in cross-section from the side, according to an embodiment of the disclosure.

FIG. 6 is an illustration of a charge tube having an integrated alignment finger engaged with a milled slot on a surface of the gun body, as viewed in cross-section from the side, according to an embodiment of the disclosure.

The alignment finger 510 integrated with the charge tube 320 is bent, for example vertically, as shown in cross-section in FIG. 6, to engage the milled slot 510. The alignment finger 510 can be formed or bent to have any appropriate shape within ordinary skill to engage the appropriate slot or opening on the gun body. Although described as a "milled" slot on the gun body, it should be apparent to those ordinarily skilled in the art that any appropriate slot or opening, achieved by any appropriate machining or manufacturing technique, can be provided on the gun body.

Figure 7:
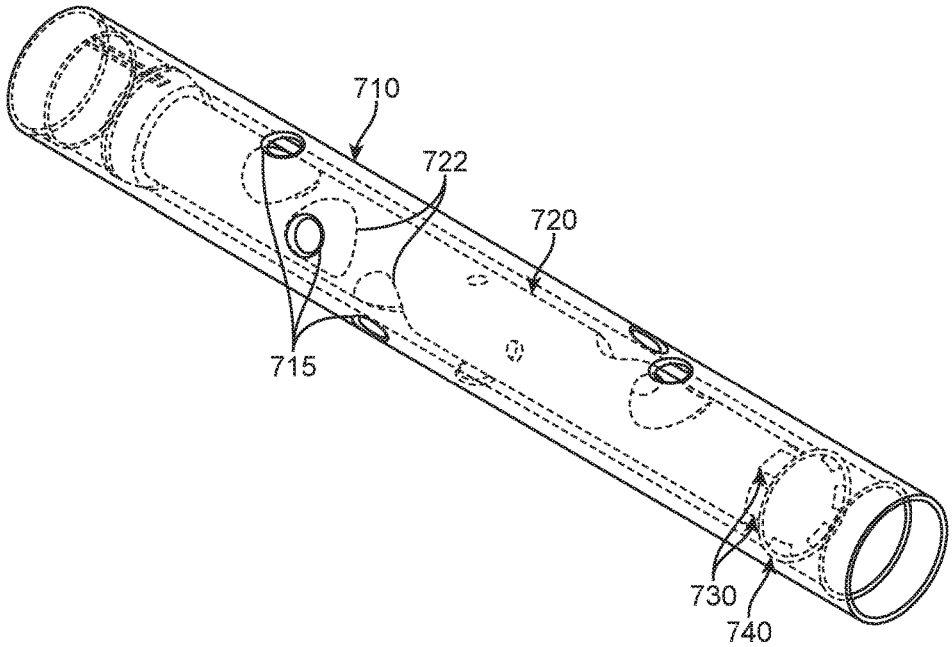
FIG. 7 is a diagram of a partially-assembled gun body with a charge tube having a plurality of centralizing bend tabs received in the gun body.

Reference is now made to FIG. 7 showing a diagram of a partially assembled gun body having a charge tube with a plurality of centralizing bend tabs on an end that are received within the gun body.

A gun body 710 as part of an overall perforation gun assembly, for example the assembly 34 shown in FIG. 1, has a plurality of recesses or "scallops" 715 on an exterior surface of the gun body 710. The scallops 715 provide a path for the charge material to more easily blast through after detonation of the charges. The gun body 710 is for receiving a charge tube 720. The charge tube 720 has a plurality of openings 725 for receiving charges (not shown in FIG. 7).

A plurality of protrusions, or centralizing bend tabs 730 are formed on an end of the charge tube. A snap ring 740 secures the charge tube within the gun body, and the centralizing bend tabs 730 serve to centralize the charge tube 720 within the gun body 710.

Figure 8:
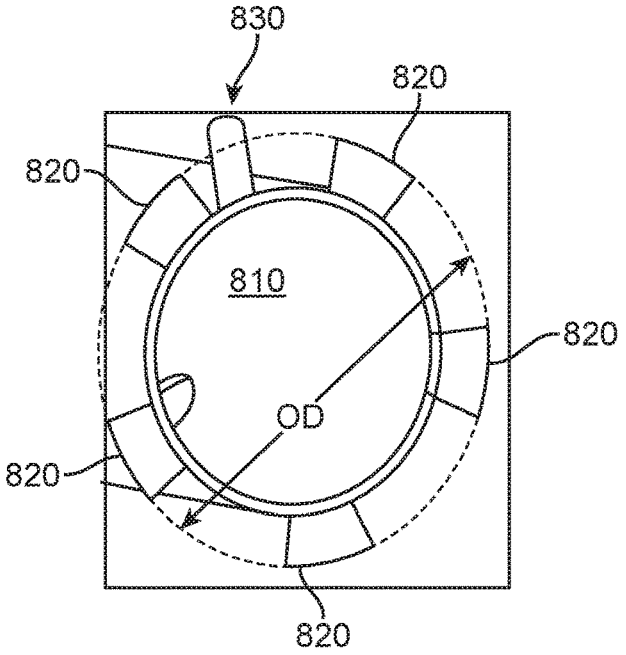
FIG. 8 is a diagram of a charge tube having a plurality of centralizing bend tabs and an alignment finger integrated with an outer surface of the charge tube, according to an embodiment of the disclosure.

FIG. 8 is a diagram of a charge tube having a plurality of projections on the end of the charge tube referred to as centralizing bend tabs and an alignment finger integrated on a circumferential outer surface of the charge tube, according to an embodiment of the disclosure. The centralizing bend tabs, or more generally "retaining projections" formed on the charge tube retain the charge tube within the gun body.

The charge tube 810 includes a plurality of centralizing bend tabs 820 that (radially) centralize the charge tube 810 within the gun body. The ends of the charge tube 810 are modified to include the projections 820 to obtain centralization of the charge tube 810 within the gun body. The tabs 820 are bent approximately vertically to have an outer diameter "OD" that is approximately equivalent to the drift diameter ("DD" in FIG. 9) of the gun body. This replaces the need for four cap screws and an alignment fixture in the gun assembly to radially centralize the charge tube within the gun body. The centralization is maintained by keeping at least five points of contact with the centralizing bend tabs, in this example embodiment. The charge tube 810 also has an alignment finger 830 on a circumferential outer surface that engages the gun body to align the charge tube with respect to the gun body.

Figure 9:
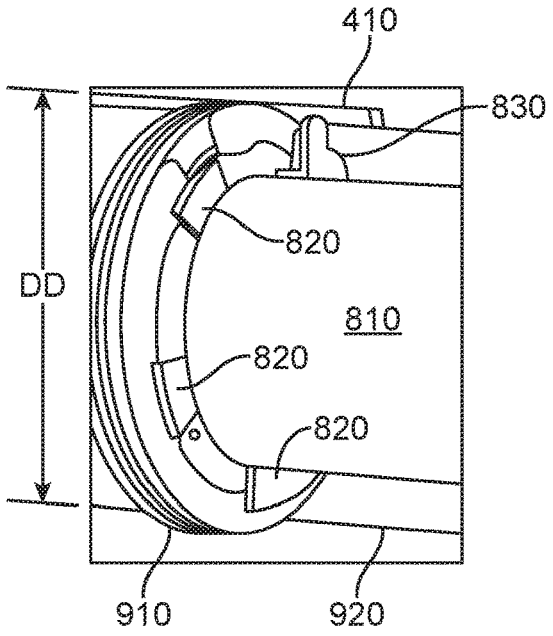
FIG. 9 is a diagram of a charge tube having a plurality of centralizing bend tabs on an end and an alignment finger on a surface thereof, the alignment finger engaged with a milled slot in a surface of a gun body, according to an embodiment of the disclosure.

FIG. 9 is a diagram of a charge tube having a plurality of centralizing bend tabs on an end and an alignment finger on a surface thereof, the alignment finger engaged with a slot in a surface of a gun body, according to an embodiment of the disclosure.

A snap ring 910 is used to secure the charge tube 820 within the gun body 920. There is no need for an alignment fixture by integrating the alignment features directly onto the charge tube by forming protrusions on an end of the charge tube and/or an alignment finger integrally with the charge tube on a circumferentially outer surface.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

We claim:

1. An apparatus comprising:

a charge tube able to be inserted into a gun body of a perforating gun assembly for use in a wellbore, the charge tube having a retaining projection integrally formed on an end of the charge tube, wherein when the charge tube is inserted into the gun body, the retaining projection engages with the gun body of the perforating gun assembly to restrict longitudinal movement of the charge tube with respect to the gun body when engaged with the gun body.

2. The apparatus of claim 1 wherein the retaining projection is integrally formed by at least one of: cutting, machining, molding, casting, forming, welding, and sintering the end of the charge tube.

3. The apparatus of claim 1 wherein the retaining projection comprises at least one alignment finger located at an end of the charge tube and that limits radial movement of the charge tube with respect to the gun body when engaged with the gun body.

4. The apparatus of claim 3 wherein at least one alignment finger is engaged in at least one slot on an inner surface of the gun body.

5. The apparatus of claim 1 further comprising a plurality of charges supported within the charge tube.

6. An apparatus comprising:

a charge tube able to be inserted into a gun body of a perforating gun assembly for use in a wellbore;

a retaining projection formed on an end of the charge tube that, when the charge tube is inserted into the gun body, engages with the gun body of the perforating gun assembly to restrict movement of the charge tube with respect to the gun body when engaged with the gun body, wherein the retaining projection comprises a plurality of collet fingers formed on the end of the charge tube that engages with the gun body thereby retaining the charge tube within the gun body.

7. The apparatus of claim 6 wherein the collet fingers engage a groove on an interior surface of the gun body.

8. The apparatus of claim 6 wherein the collet fingers are cut and formed into collet fingers on the charge tube.

9. An apparatus comprising:

a charge tube able to be inserted into a gun body of a perforating gun assembly for use in a wellbore;

a retaining projection formed on an end of the charge tube that, when the charge tube is inserted into the gun body, engages with the gun body of the perforating gun assembly to restrict movement of the charge tube with respect to the gun body when engaged with the gun body, wherein the retaining projection comprises a plurality of collet fingers that engage with a groove formed on an interior surface of the gun body and the retaining projection further comprises an alignment finger that radially engages with a slot on the interior surface of the gun body.

10. A perforating gun assembly for use in a wellbore comprising:

a perforating gun body; and a charge tube disposed within the perforating gun body, the charge tube having a retaining projection integrally formed on an end of the charge tube, wherein when the charge tube is inserted into the gun body, engages with the gun body of the perforating gun assembly to restrict longitudinal movement of the charge tube when engaged with the gun body.

11. The perforating gun assembly of claim 10 wherein the retaining projection is formed by at least one of: cutting, machining, molding, casting, welding, forming, or sintering the charge tube.

12. The perforating gun assembly of claim 10 further comprising a plurality of charges supported within the charge tube.

13. The perforating gun assembly of claim 10 wherein the retaining projection comprises at least one alignment finger formed on the end of the charge tube that limits radial movement of the charge tube with respect to the gun body when engaged with the gun body.

14. The perforating gun assembly of claim 10 wherein the retaining projection comprises a plurality of centralizing bend tabs formed on the charge tube to restrict radial movement of the charge tube when inserted in the gun body.

15. A perforating gun assembly for use in a wellbore comprising;

a perforating gun body;

a charge tube disposed within the perforating gun body; and a retaining projection formed on an end of the charge tube that, when the charge tube is inserted into the gun body, engages with the gun body of the perforating gun assembly to restrict movement of the charge tube when engaged with the gun body, wherein the retaining projection comprises a plurality of collet fingers formed on the end of the charge tube that engage a groove on an inner surface of the gun body, the plurality of collet fingers configured to retain the charge tube within the gun body.

16. An apparatus comprising:

a charge tube able to be inserted into a gun body of a perforating gun assembly for use in a wellbore, the charge tube having a plurality of centralizing bend tabs extending from an end of the charge tube, wherein the plurality of centralizing bend tabs are formed by deforming the end of the charge tube, wherein the plurality of centralizing bend tabs restrict radial movement of the charge tube when inserted in the gun body.

17. The apparatus of claim 16 wherein the plurality of centralizing bend tabs engage an inner surface of the gun body to restrict radial movement of the charge tube with respect to the gun body.

* * * * *